US010830520B2

(12) United States Patent
Yu et al.

(10) Patent No.: US 10,830,520 B2
(45) Date of Patent: Nov. 10, 2020

(54) REFRIGERATOR AND METHOD OF MANUFACTURING THE SAME

(71) Applicant: LG ELECTRONICS INC., Seoul (KR)

(72) Inventors: Seonil Yu, Gyeongsangnam-do (KR); Kyeongchul Cho, Gyeongsangnam-do (KR); Insun Yeo, Gyeongsangnam-do (KR); Hongsik Kwon, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 397 days.

(21) Appl. No.: 15/604,832

(22) Filed: May 25, 2017

(65) Prior Publication Data

US 2017/0328624 A1 Nov. 16, 2017

Related U.S. Application Data

(63) Continuation of application No. 13/501,491, filed as application No. PCT/KR2011/004498 on Jun. 20, 2011.

(30) Foreign Application Priority Data

Jun. 22, 2010 (KR) ..... 10-2010-0058853
Jun. 22, 2010 (KR) ..... 10-2010-0058858

(51) Int. Cl.

| | |
|---|---|
| ***F25D 11/00*** | (2006.01) |
| ***F25D 23/02*** | (2006.01) |
| ***F25D 23/12*** | (2006.01) |

(52) U.S. Cl.
CPC ..... *F25D 11/00* (2013.01); *F25D 23/02* (2013.01); *F25D 23/126* (2013.01); *F25D 2323/023* (2013.01)

(58) Field of Classification Search
CPC ..... B67D 2210/00031; B67D 2210/00036; F25D 2323/121; F25D 2323/122; F25D 2323/123; F25D 2400/10; F25D 23/126
(Continued)

(56) References Cited

U.S. PATENT DOCUMENTS 1,275,511 A 8/1918 Welch
1,927,398 A 9/1933 Glasser
(Continued)

FOREIGN PATENT DOCUMENTS

CN 1464267 12/2003
CN 1599856 3/2005
(Continued)

OTHER PUBLICATIONS

Indian Office Action in Indian Application No. 160/KOLNP/2013, dated Jan. 15, 2018, 7 pages.
(Continued)

*Primary Examiner* — Steve S Tanenbaum
(74) *Attorney, Agent, or Firm* — Fish & Richardson P.C.

(57) ABSTRACT

Provided is a refrigerator including a cabinet forming one of a refrigerator compartment and a freezer compartment, a main door opening and closing the refrigerator compartment or the freezer compartment and including a storage space opened forward, a sub door installed on the main door and opening and closing the storage space of the main door, and a dispenser disposed on the sub door and dispensing water.

10 Claims, 11 Drawing Sheets

(58) Field of Classification Search
USPC ..... 62/377, 389
See application file for complete search history.

(56) References Cited

U.S. PATENT DOCUMENTS

| | | | | |
|---|---|---|---|---|
| 2,046,909 | A | 7/1936 | Terry et al. | |
| 2,051,132 | A | 8/1936 | Dart | |
| 2,095,811 | A | 10/1937 | Goulooze | |
| 2,112,771 | A | 3/1938 | Goulooze | |
| 2,129,923 | A | 9/1938 | Mortimer | |
| 2,130,617 | A | 9/1938 | Dockham | |
| 2,131,680 | A | 9/1938 | Zahodiakin | |
| 2,135,878 | A | 11/1938 | Sekyra | |
| 2,150,064 | A | 3/1939 | Robert | |
| 2,213,274 | A | 9/1940 | Flamm | |
| 2,276,937 | A | 3/1942 | Arturo | |
| 2,653,851 | A | 9/1953 | Davidson | |
| 2,692,813 | A | 10/1954 | Toronto | |
| 3,140,134 | A | 7/1964 | Nairn | |
| 3,218,111 | A | 11/1965 | Steiner | |
| 3,389,424 | A | 6/1968 | Fellwock | |
| 3,429,140 | A | 2/1969 | White | |
| 3,510,986 | A | 5/1970 | Berkowitz | |
| 3,836,221 | A | 9/1974 | Whistler | |
| 4,087,140 | A | 5/1978 | Linstromberg | |
| 4,302,907 | A | 12/1981 | Canals et al. | |
| 4,368,622 | A | 1/1983 | Brooks | |
| 4,514,021 | A | 4/1985 | Sundermeier et al. | |
| 5,096,095 | A * | 3/1992 | Burton | F25D 23/126 222/146.6 |
| 5,111,618 | A | 5/1992 | Kaspar | |
| 5,209,082 | A | 5/1993 | Ha | |
| 5,359,795 | A | 11/1994 | Mawby et al. | |
| RE35,120 | E | 12/1995 | Heaney | |
| 5,584,902 | A | 12/1996 | Hartig | |
| 5,813,246 | A | 9/1998 | Oh | |
| 5,966,963 | A | 10/1999 | Kovalaske | |
| 6,055,823 | A | 5/2000 | Baker et al. | |
| 6,193,340 | B1 | 2/2001 | Schenker | |
| 6,268,594 | B1 | 7/2001 | Leutner et al. | |
| 6,375,291 | B1 | 4/2002 | Nam et al. | |
| 6,708,518 | B1 | 3/2004 | Jones | |
| 6,722,142 | B1 | 4/2004 | Pagel | |
| 7,008,032 | B2 | 3/2006 | Chekal | |
| 7,194,872 | B2 | 3/2007 | Kim | |
| 7,340,915 | B2 | 3/2008 | Kwon | |
| 7,360,374 | B2 | 4/2008 | LaRose | |
| 7,596,964 | B2 | 10/2009 | Lim et al. | |
| 2003/0019236 | A1 | 1/2003 | Heims | |
| 2004/0137235 | A1 | 7/2004 | Paul | |
| 2004/0182103 | A1 | 9/2004 | Jung | |
| 2004/0183414 | A1 * | 9/2004 | Kwon | F25D 23/02 312/401 |
| 2005/0039482 | A1 | 2/2005 | Kim | |
| 2005/0188506 | A1 | 9/2005 | Lee et al. | |
| 2005/0258724 | A1 | 11/2005 | Hwa | |
| 2006/0005484 | A1 | 1/2006 | Riblier et al. | |
| 2006/0265960 | A1 | 11/2006 | Leimkuehler | |
| 2006/0265979 | A1 | 11/2006 | Cording | |
| 2007/0018548 | A1 | 1/2007 | Ertz et al. | |
| 2007/0144203 | A1 | 6/2007 | Kim | |
| 2007/0163286 | A1 | 7/2007 | Lim | |
| 2008/0006042 | A1 | 1/2008 | Lee | |
| 2008/0120987 | A1 | 5/2008 | Park et al. | |
| 2009/0044560 | A1 | 2/2009 | Buchstab | |
| 2009/0056363 | A1 * | 3/2009 | Lee | F25C 5/22 62/389 |
| 2009/0075069 | A1 | 3/2009 | Myli | |
| 2009/0249818 | A1 | 10/2009 | Kim | |
| 2009/0272136 | A1 | 11/2009 | Knoell | |
| 2009/0282857 | A1 | 11/2009 | An | |
| 2010/0107679 | A1 | 5/2010 | Park et al. | |
| 2010/0308705 | A1 | 12/2010 | Kwon | |
| 2010/0319388 | A1 | 12/2010 | Yang et al. | |
| 2011/0139817 | A1 * | 6/2011 | Lu | F25D 27/00 62/264 |

FOREIGN PATENT DOCUMENTS

| | | |
|---|---|---|
| CN | 1683870 | 10/2005 |
| CN | 1721790 | 1/2006 |
| CN | 1627016 | 6/2008 |
| EP | 0539558 | 12/1992 |
| EP | 1813896 | 1/2007 |
| JP | 50-043963 | 5/1975 |
| JP | 50-050464 | 5/1975 |
| JP | 56-164495 | 12/1981 |
| JP | 63-142682 | 9/1988 |
| JP | 06-066473 | 3/1994 |
| JP | 10-009757 | 1/1998 |
| JP | 2000-065459 | 3/2000 |
| JP | 2001-108357 | 4/2001 |
| JP | 2002-323287 | 11/2002 |
| JP | 2006-038437 | 2/2006 |
| JP | 2009-103395 | 5/2009 |
| KR | 1990-0008203 | 9/1990 |
| KR | 1996-0011364 | 4/1996 |
| KR | 1997-0022164 | 5/1997 |
| KR | 10-0138562 | 2/1998 |
| KR | 1999-042339 | 6/1999 |
| KR | 1999-062159 | 7/1999 |
| KR | 1999-037440 | 10/1999 |
| KR | 1999-0039593 | 11/1999 |
| KR | 20-0164322 | 2/2000 |
| KR | 20-0168373 | 2/2000 |
| KR | 2002-0083115 | 11/2002 |
| KR | 10-0376167 | 3/2003 |
| KR | 20-0314145 | 5/2003 |
| KR | 2003-0083813 | 11/2003 |
| KR | 2005-0111094 | 11/2005 |
| KR | 10-596533 | 7/2006 |
| KR | 10-0733309 | 6/2007 |
| KR | 10-0756467 | 9/2007 |
| KR | 10-2008-0046848 | 5/2008 |
| KR | 10-0887575 | 3/2009 |
| KR | 2009-0077564 | 7/2009 |
| KR | 2009124904 A | 12/2009 |
| RU | 2330221 | 7/2008 |
| RU | 2358211 | 6/2009 |
| WO | 2003/033976 | 4/2003 |
| WO | 2004/059228 | 7/2004 |
| WO | 2005/052477 | 6/2005 |
| WO | WO2007087699 A | 8/2007 |
| WO | WO2008096982 A | 8/2008 |
| WO | 2010/023090 | 3/2010 |

OTHER PUBLICATIONS

U.S. Office Action dated Mar. 29, 2013 for U.S. Appl. No. 13/391,632, 10 pages.
U.S. Office Action dated Jul. 1, 2013 for U.S. Appl. No. 13/390,946, 24 pages.
Korean Office Action dated Oct. 10, 2013 for Application No. 10-2010-0058858, with English Translation, 6 pages.
Russian Notice of Allowance dated Feb. 14, 2014 for Application No. 2013102589, in English, 7 pages.
European Search Report dated Jun. 16, 2014 for Application No. EP 11 79 8360, 7 Pages.
Chinese Office Action dated Jul. 7, 2014 for Chinese Application No. 201180031251.0, with English Translation, 11 pages.
Australian Notice of Acceptance dated Dec. 17, 2014 for Application No. 2011269999, 2 pages.
U.S. Office Action dated Oct. 29, 2013 for U.S. Appl. No. 13/391,632, 9 pages.
Canadian Office Action dated Apr. 30, 2015 for Canadian Application No. 2,803,819, 4 Pages.

* cited by examiner

REFRIGERATOR AND METHOD OF MANUFACTURING THE SAME

CROSS REFERENCE TO RELATED APPLICATIONS

This application is a continuation of U.S. application Ser. No. 13/501,491, filed Apr. 12, 2012, which is a U.S. National Phase Application under 35 U.S.C. § 371 of International Application PCT/KR2011/004498, filed on Jun. 20, 2011, which claims the benefit of Korean Application Nos. 10-2010-0058853 and 10-2010-0058858, filed on Jun. 22, 2010, the entire contents of the prior applications are hereby incorporated by reference in their entireties.

TECHNICAL FIELD

The present disclosure relates to a refrigerator and a method of manufacturing the refrigerator.

BACKGROUND ART

Refrigerators are electric appliances for storing foods at low temperature in a storing space closed by a door. The storing space is cooled with cool air that exchanges heat with refrigerant in refrigeration cycles, thereby optimally storing foods.

Along with the change of people's eating patterns and preference, large and multifunctional refrigerators have been introduced, and various comfortable structures have been added to refrigerators.

For example, a refrigerator may include a dispenser for dispensing cool water without opening a door of the refrigerator. Such a dispenser is installed on an exterior part of a refrigerator door, and dispenses water according to a user's operation.

DISCLOSURE

Technical Problem

Embodiments provide a refrigerator including a main door having a storage space, and a sub door for opening and closing the storage space and including a dispenser, thereby improving user convenience.

Embodiments also provide a refrigerator manufacturing method in which an outer case is integrally formed with a dispenser through a forming process, thereby improving an appearance and simplifying a manufacturing process.

Technical Solution

In one embodiment, a refrigerator includes: a cabinet forming one of a refrigerator compartment and a freezer compartment; a main door opening and closing the refrigerator compartment or the freezer compartment and including a storage space opened forward; a sub door installed on the main door and opening and closing the storage space of the main door; and a dispenser disposed on the sub door and dispensing water.

In another embodiment, a refrigerator includes: a cabinet forming one of a refrigerator compartment and a freezer compartment; a main door opening and closing the refrigerator compartment or the freezer compartment and including an opening; a sub door installed on the main door and opening and closing the opening of the main door; and a dispenser disposed on the sub door and dispensing water, wherein the dispenser includes: a recess formed by recessing an outer case that constitutes a front surface of the sub door and that is formed of a metal material; cut parts formed by cutting the outer case at an upper side and a lower side of the recess; and a dispensing member disposed in the cut part at the upper side of the recess to dispense drinking water.

In another embodiment, a refrigerator manufacturing method includes: forming an outer case constituting an exterior of a sub door and formed of a metal material, wherein the sub door is installed on a main door opening and closing a storing space of a cabinet and provided with a storage space opened forward, and opens and closes the storage space; cutting portions of the outer case to correspond to an upper end and a lower end of a recess, to dispense drinking water; recessing the outer case inward to form the recess; and installing a dispensing member for dispensing water, in the cut portion of the recess.

In another embodiment, a refrigerator includes: a cabinet forming a storing space; a main door opening and closing the storage space; a main hinge fixed to the cabinet and supporting an upper end and a lower end of the main door to rotate the main door; a storage unit forming a storage space in the main door and opened through a front surface of the main door; a sub door opening and closing the storage space; a sub hinge disposed between the main door and the sub door and supporting the sub door such that the sub door rotates; and a dispenser disposed in a front surface the sub door and dispensing drinking water.

The details of one or more embodiments are set forth in the accompanying drawings and the description below. Other features will be apparent from the description and drawings, and from the claims.

Advantageous Effects

According to the embodiments, a storage space is disposed in a main door, and is opened and closed with a sub door. Thus, even when a food is frequently taken out or put in, a loss of cool air can be decreased, thereby reducing power consumption.

Since a dispenser is installed on the sub door, drinking water can be conveniently dispensed. In addition, since the main door is provided with the dispenser as well as the storage space, the refrigerator can be more conveniently used.

A cap decor constituting the upper end of the sub door also constitutes the upper end of the refrigerator door, and a handle is disposed in the cap decor, so that the handle is hidden from the outside, thereby improving the appearance of the refrigerator.

The cap decor covers a sub hinge to hide the sub hinge from the outside, thus further improving the appearance of the refrigerator.

A recess of the dispenser is integrally formed with the outer case forming the appearance of the door.

Thus, the recess and the rest of the outer case except for the recess are formed of the same material and have the same figure or a continuous figure/pattern. Accordingly, the appearance of the refrigerator is improved.

In addition, the recess is formed of the same metal material as that of the outer case, instead of an injection-molded material having a metal texture, thereby providing the sense of unity, and improving the appearance.

Since the recess is naturally formed by forming the outer case, a process of manufacturing the refrigerator according to the embodiment can be further simplified than a process of manufacturing a refrigerator including a separate dispenser on a door, thus improving the productivity.

MODE FOR INVENTION

Reference will now be made in detail to the embodiments of the present disclosure, examples of which are illustrated in the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein.

A top mount type refrigerator in which a freezer compartment is disposed over a refrigerator compartment will be exemplified in the following embodiments, for convenience in description, but the present invention is not limited thereto, and thus, the present disclosure may be applied to any refrigerator including a dispenser.

Figure 1:
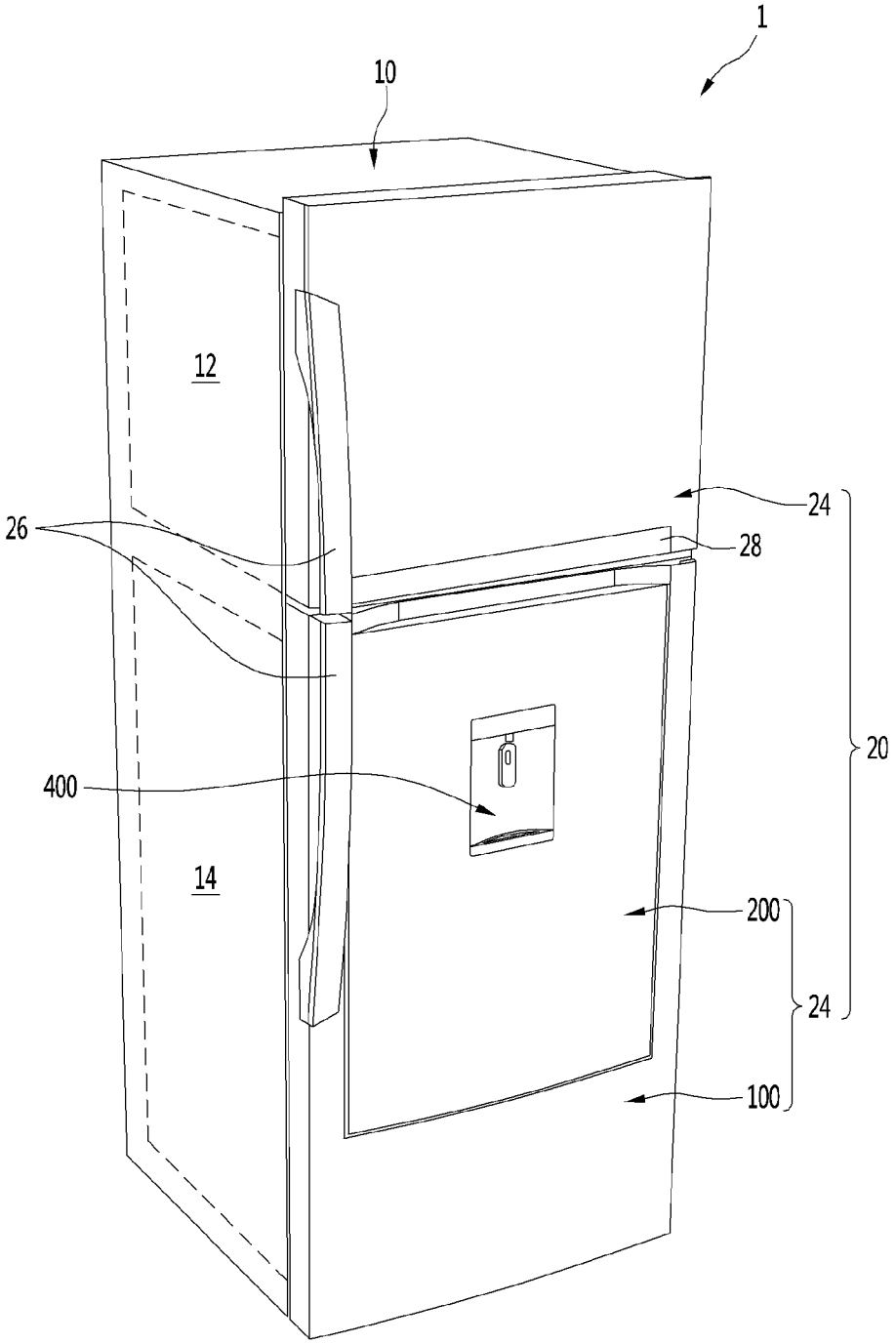
FIG. 1 is a perspective view illustrating a refrigerator according to an embodiment.

FIG. 1 is a perspective view illustrating a refrigerator according to an embodiment.

Referring to FIG. 1, a refrigerator 1 according to an embodiment includes a cabinet 10 including a storage space therein, and doors 20 opening and closing the storage space. The cabinet 10 and the doors 20 form an appearance of the refrigerator 1.

The storage space is divided into an upper part and a lower part. A freezer compartment 12 and a refrigerator compartment 14 are disposed in the upper and lower portions of the cabinet 10, respectively. The doors 20 include a freezer door 22 and a refrigerator door 24, which open and close the freezer compartment 12 and the refrigerator compartment 14, respectively.

The doors 20 are rotatable, and include door handles 26 at a side thereof, so that a user can rotate the doors 20 to open and close the refrigerator compartment 14 and the freezer compartment 12.

A display 28 may be disposed on the front surface of the door 20 to display an operation state of the refrigerator 1. The display 28 may include manipulation buttons to manipulate the refrigerator 1. The door 20 may include a dispenser 400 to dispense water outside the refrigerator 1.

Hereinafter, a configuration of the refrigerator door 24 will now be described.

Figure 2:
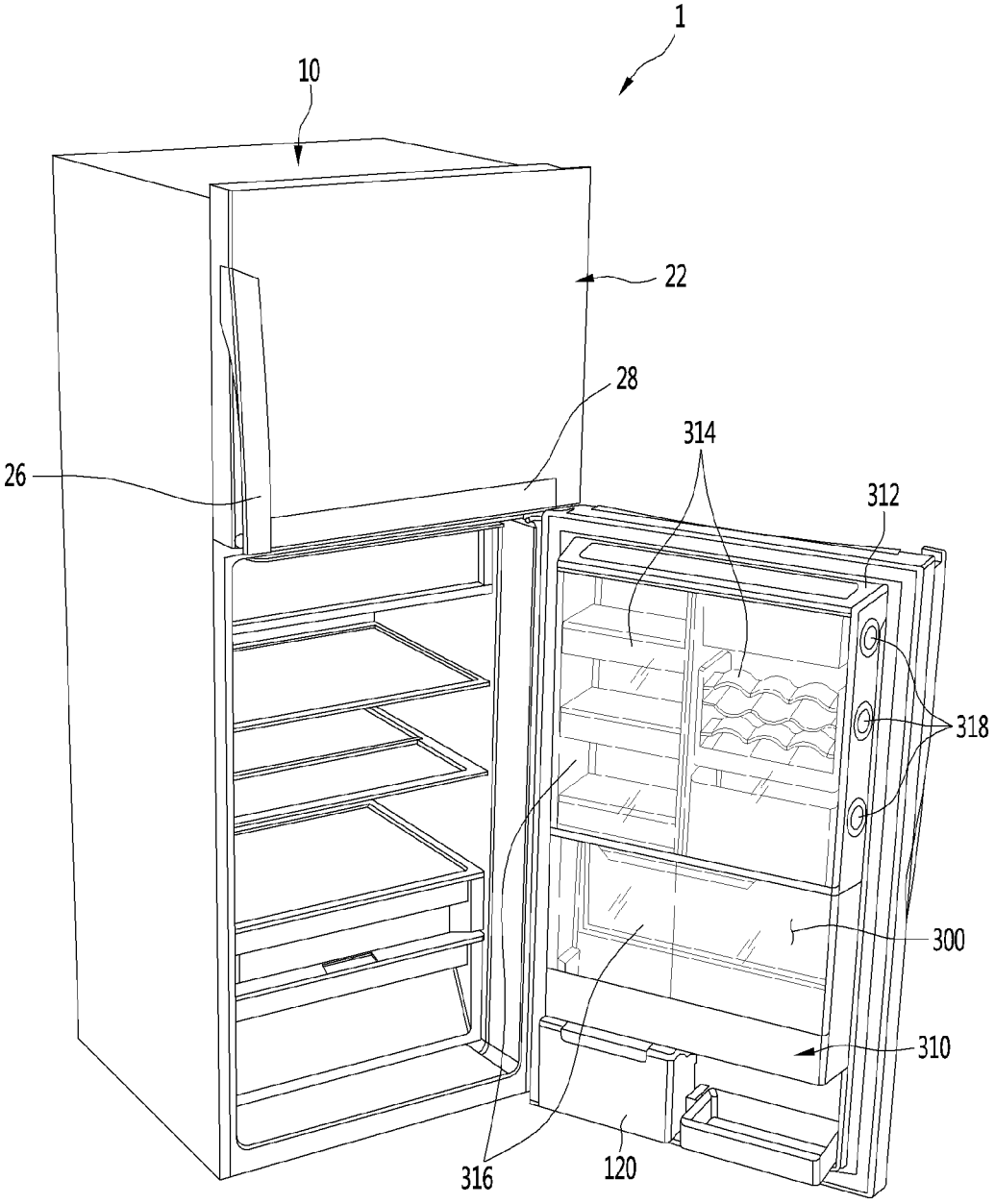
FIG. 2 is a perspective view illustrating a state in which a main door of the refrigerator of FIG. 1 is opened.
Figure 3:
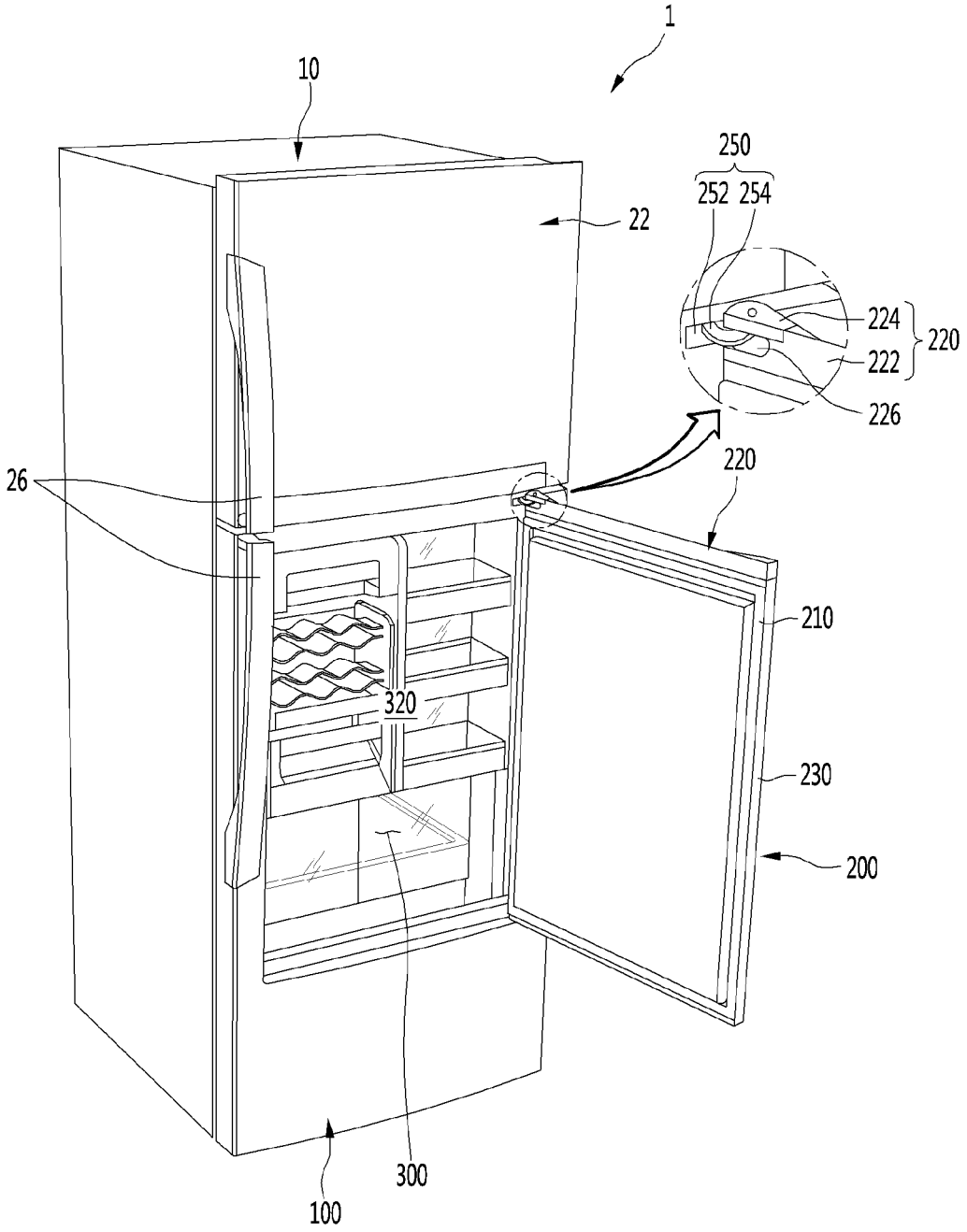
FIG. 3 is a perspective view illustrating a state in which a sub door of the refrigerator of FIG. 1 is opened.
Figure 4:
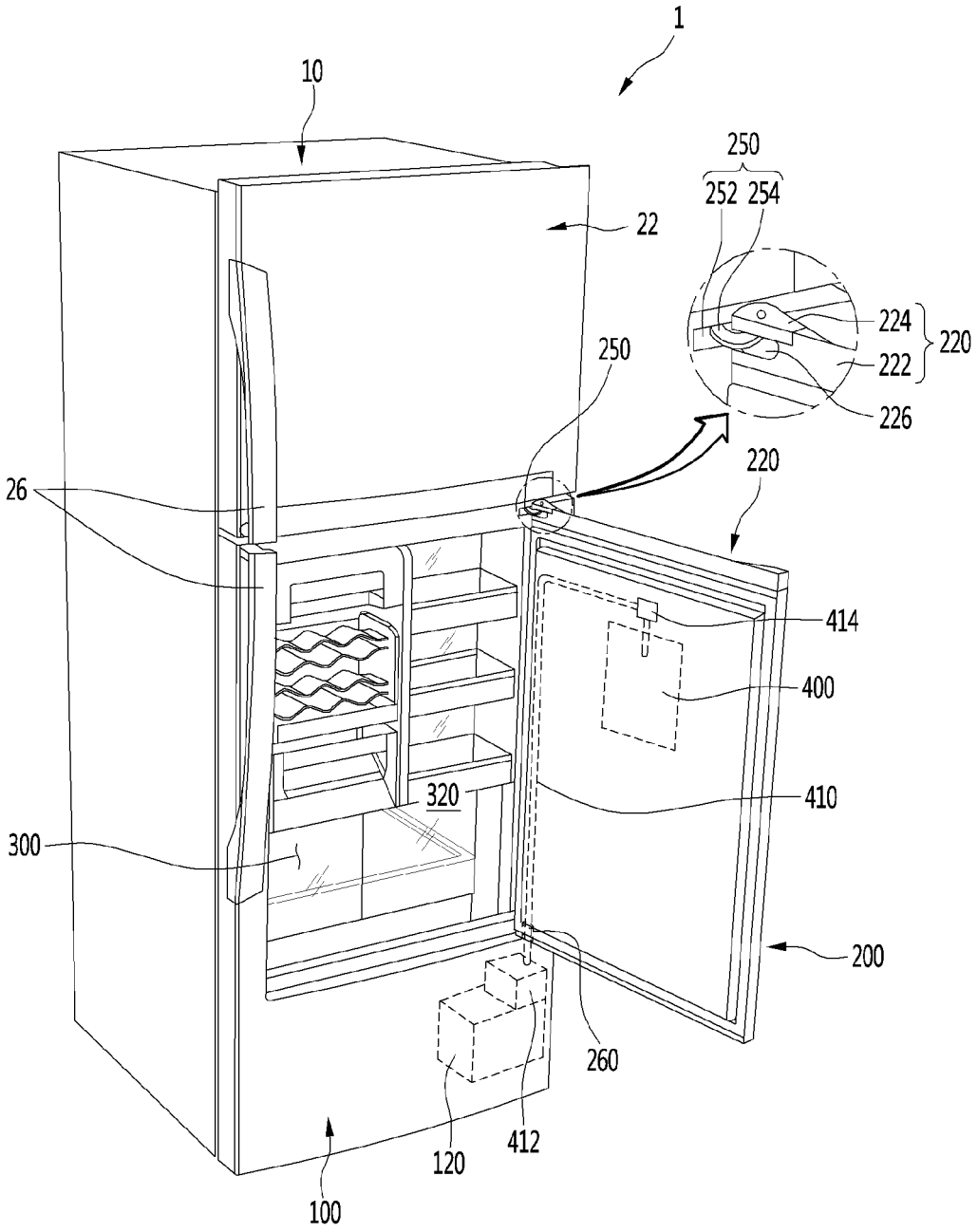
FIG. 4 is a perspective view illustrating a water supply passage of the refrigerator of FIG. 1.
Figure 5:
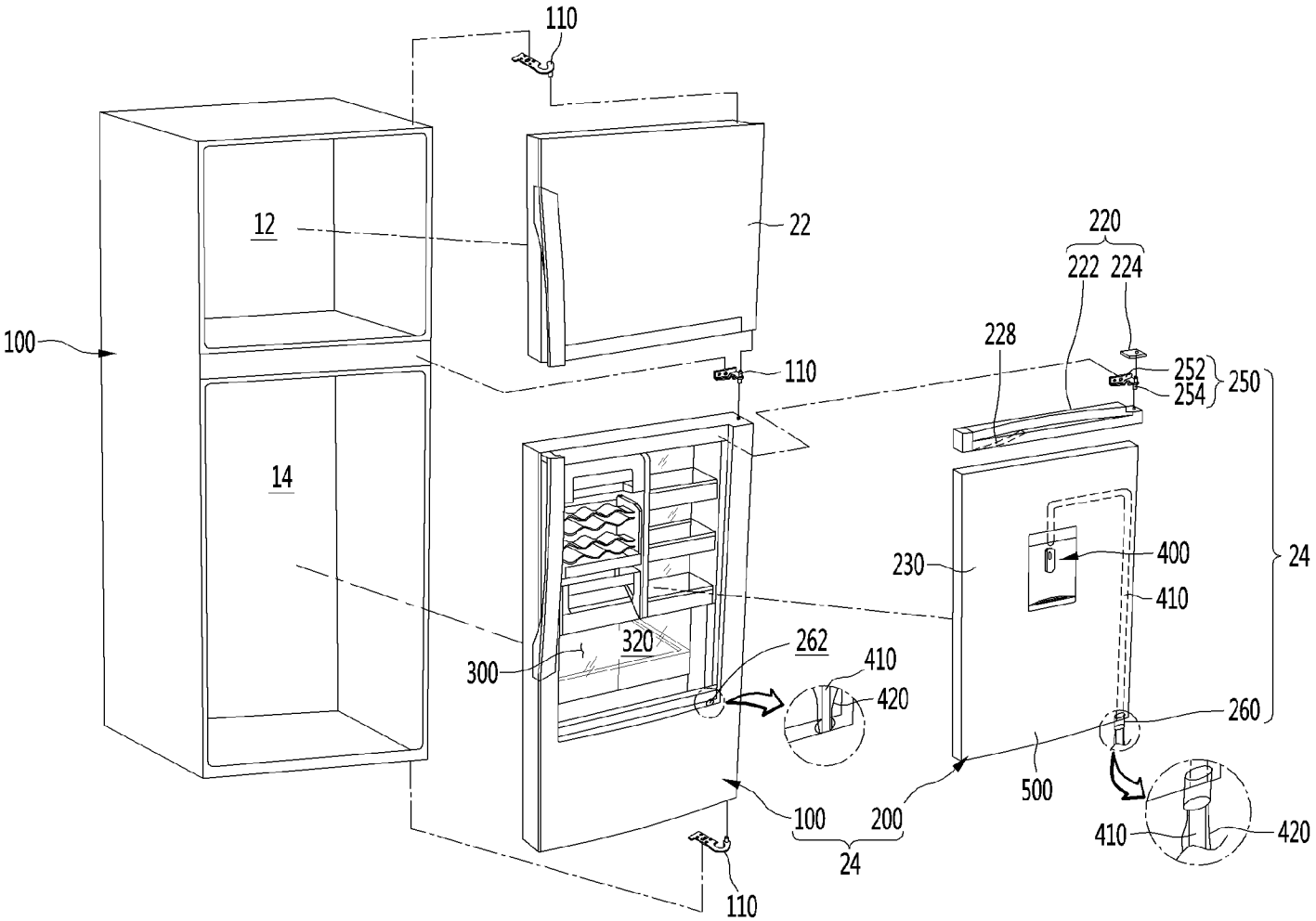
FIG. 5 is an exploded perspective view illustrating a coupling structure of the main door of FIG. 2 and the sub door of the FIG. 3.
Figure 6:
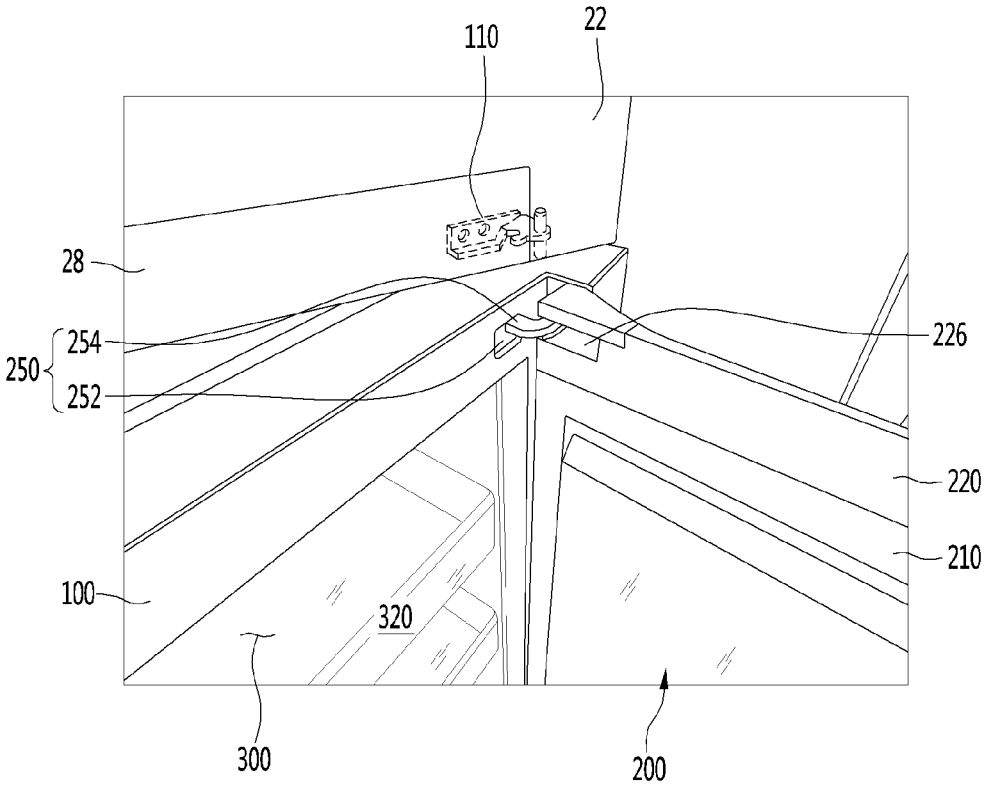
FIG. 6 is a perspective view illustrating rotations of the main door of FIG. 2 and the sub door of the FIG. 3.

FIG. 2 is a perspective view illustrating a state in which a main door of a refrigerator is opened, according to the current embodiment. FIG. 3 is a perspective view illustrating a state in which a sub door of a refrigerator is opened, according to the current embodiment. FIG. 4 is a perspective view illustrating a water supply passage of a refrigerator according to the current embodiment. FIG. 5 is an exploded perspective view illustrating a coupling structure of the main door of FIG. 2 and the sub door of the FIG. 3, according to the current embodiment. FIG. 6 is a perspective view illustrating rotations of the main door of FIG. 2 and the sub door of the FIG. 3, according to the current embodiment.

Referring to FIGS. 2 to 6, the refrigerator door 24 includes a main door 100 and a sub door 200. The main door 100 entirely covers a front opening of the refrigerator compartment 14.

Main hinges 110 are installed at the upper and lower ends of the main door 100, respectively. The main hinges 110 are fixed to the cabinet 10, and are coupled through shafts to the upper and lower ends of the main door 100, so that the main door 100 can rotate to open and close the refrigerator compartment 14.

One of the main hinges 110 may be disposed between the refrigerator door 24 and the freezer door 22 to support the upper end of the refrigerator door 24 and the lower end of the freezer door 22. Alternatively, although not shown, the main hinges 110 may be disposed on the upper and lower ends of each of the refrigerator door 24 and the freezer door 22, respectively.

The main door 100 may include a storage space 300 for storing a food. The storage space 300 is formed by a storage unit 310 installed on the rear surface of the main door 100. A food can be put in or taken out from the storage space 300 through an opening 320 of the front surface of the main door 100.

In detail, the storage unit 310 is disposed on the rear surface of the main door 100, and includes a frame 312 forming an appearance of the storage unit 310, and storage members 314 disposed inside the frame 312. The frame 312 extends from the lower side of the opening 320 to the upper end of the main door 100 to form the storage space 300, and protrudes rearward. A plurality of covers 316 may be disposed on the frame 312 to open and close separate rooms in the storage space 300 after the main door 100 is opened.

Cool air inlets 318 may be disposed in a side portion of the storage unit 310. The cool air inlets 318 contact an inner wall of the refrigerator compartment 14 when the main door 100 is closed. A cool air duct (not shown) may be disposed in the inner wall of the refrigerator compartment 14. When the main door 100 is closed, the cool air duct is connected to the cool air inlets 318 to discharge cool air into the storage space 300.

The storage members 314 disposed inside the frame 312 may have various shapes including a basket shape and a shelf shape according to the types of foods to store. Since the storage members 314 disposed inside the frame 312 can be freely removed, various shaped spaces can be formed by combining the storage members 314.

Access to the storage space 300 formed by the storage unit 310 is allowed by opening the main door 100, so that a food can be stored in the storage space 300 through the rear portion of the main door 100. When the main door 100 is closed, access to the storage space 300 may be allowed by opening the sub door 200. In this case, a food can be stored in the storage space 300 through the opening 320 at the front side of the main door 100.

The main door 100 may include a water tank 120. The water tank 120 stores water to supply to the dispenser 400, and may be removably attached to the rear surface of the main door 100. The water tank 120 may be disposed in the storage space 300, or be disposed in the rear surface of the main door 100 outside the storage space 300.

The sub door 200 is coupled to the main door 100. The sub door 200 opens and closes the storage members 314, and has a size corresponding to the opening 320.

The sub door 200 includes an outer case 500 forming an appearance of the sub door 200, and a door liner 510 coupled to the outer case 500 to form a rear surface of the sub door 200. A thermal insulator (not shown) is disposed between the outer case 500 and the door liner 510.

The outer case 500 may be formed of a metal such as a stainless steel plate. The outer case 500 constitutes the front surface of the sub door 200, and at least one portion of the edge of the sub door 200. When the door 20 is closed, the outer case 500 constitutes a front appearance of the door 20.

A film may be attached to the front surface of the outer case 500, and may have various figures or patterns through a hair line process or a corrosion process. The outer case 500 may have a planar front surface or a curved front surface that is at least partially curved forward. A part constituting the appearance of the main door 100 may be formed of the same material as that of the outer case 500 of the sub door 200.

When the sub door 200 is closed, the sub door 200 may be flush with the front surface of the main door 100. The upper end of the sub door 200 and the upper end of the main door 100 are disposed at the same height. That is, the sub door 200 and the main door 100 share the upper end of the refrigerator door 24. The left, right, and lower ends of the sub door 200 are disposed inward from the left, right, and lower ends of the main door 100.

The sub door 200 may have a width corresponding to the display 28 disposed in the lower end of the freezer door 22. The distance between the left end of the sub door 200 and the left end of the main door 100 may be equal to the distance between the right end of the sub door 200 and the right end of the main door 100.

That is, the sub door 200 is spaced apart from the left and right ends of the main door 100. Thus, the door handle 26 may be disposed on a portion of the main door 100 at a side of the sub door 200. Spaces in which the main hinges 110 are installed are disposed at another side of the sub door 200.

The rear surface of the sub door 200 may protrude in a shape corresponding to a stepped part of the opening 320. Thus, when the sub door 200 is closed, the sub door 200 can seal the storage space 300. A gasket 210 is disposed on the edge of the rear surface of the sub door 200, and closely contacts the main door 100 to prevent leakage of cool air. The gasket 210 may include a magnet, and thus, can closely contact the main door 100 by magnetic force of the magnet. The sub door 200 may include a locking structure such as a latch structure to selectively lock the sub door 200 to the main door 100.

A cap decor 220 is disposed in the upper end of the sub door 200. The cap decor 220 constitutes the upper portion of the sub door 200, and may be formed of a plastic material that is different from the material constituting the front surface of the sub door 200. The cap decor 220 may be coupled to a main body of the sub door 200.

The cap decor 220 may include a sub door handle 228. The sub door handle 228 is recessed downward. A user can hold the sub door handle 228, so that a user can easily rotate the sub door 200. The sub door handle 228 is disposed on the cap decor 220 at a position far away from sub hinges 240 to be described later, and facilitates a rotation of the sub door 200.

Since the sub door handle 228 is disposed at the upper end of the sub door 200, when the sub door 200 and the main door 100 are closed, the sub door handle 228 is disposed just under the freezer door 22. Thus, a user may put his/her hand into a space between the freezer door 22 and the refrigerator door 24, and holds the sub door handle 228, to open the sub door 200. The sub door handle 228 may be hidden from the front side when the main door 100 and the sub door 200 are closed.

The cap decor 220 includes a fixing part 222 coupled to the upper end of a main body 230 of the sub door 200, and a cover 224 covering the sub hinge 240 to be described later. The fixing part 222 and the cover 224 are coupled to each other to constitute a hinge installation part 226 on which an upper sub hinge 250 disposed at the upper side of the sub door 200 is installed.

In detail, the fixing part 222 is installed on the upper end of the main body 230 of the sub door 200, and then, the upper sub hinge 250 is installed on the hinge installation part 226. The cover 224 is installed on the fixing part 222 to fix and hide the upper sub hinge 250. Accordingly, when the sub door 200 is closed, the sub hinge 240 is not exposed to the outside.

In detail, the sub hinges 240 include the upper sub hinge 250 supporting the upper end of the sub door 200, and a lower sub hinge 260 supporting the lower end thereof.

The upper sub hinge 250 may be disposed on the upper side of the main door 100 and the opening 320. The upper sub hinge 250 includes a coupling part 252 coupled to the main door 100, and a hinge part 254 installed on the hinge installation part 226. The coupling part 252 has a plate shape, and is fixed to the upper portion of the main door 100 by a coupling member such as a screw. The hinge part 254 protrudes perpendicularly to the coupling part 252, and is inserted in the hinge installation part 226. A hinge shaft extends from an end of the hinge part 254, and is perpendicular to the hinge part 254, and is inserted in the cap decor 220.

The lower sub hinge 260 may be disposed at the upper side of the main door 100 and the opening 320. The lower sub hinge 260 protrudes upward from the lower end of the opening 320 of the main door 100, and is inserted in the lower end of the sub door 200 to function as a rotation shaft of the sub door 200.

The lower sub hinge 260 may be fixed to the main door 100. A hinge hole 262 for receiving the lower sub hinge 260 may be disposed in the bottom surface of the sub door 200 at a position corresponding to the lower sub hinge 260. Alternatively, the lower sub hinge 260 may protrude downward from the bottom surface of the sub hinge 240, and the hinge hole 262 corresponding to the lower sub hinge 260 may be disposed in the main door 100.

The lower sub hinge 260 may have a hollow tube shape. The lower sub hinge 260 may have upper and lower openings. A water supply passage for supplying water to the dispenser 400 and/or a wire 420 for supplying power to electric/electronic parts of the sub door 200 may be guided by the lower sub hinge 260.

In detail, a water supply passage 410 and the wire 420 are provided to the sub door 200 to drive electric/electronic parts provided to the dispenser 400 and the sub door 200. The water supply passage 410 and the wire 420 are guided from the main door 100 to the sub door 200 through the inner space of the lower sub hinge 260.

The water supply passage 410 is disposed in the main door 100 and the sub door 200 to guide water from the water tank 120 to the dispenser 400. The water supply passage 410 is connected to the water tank 120 in the main door 100, and is guided into the sub door 200 through the lower sub hinge 260 at a side of the main door 100. The water supply passage 410 is connected to the dispenser 400 in the sub door 200 to supply water.

A valve 414 and a pump 412 for supplying water to the dispenser 400 may be disposed on the water supply pipe 400. The valve 414 and the pump 412 may be disposed in the main door 100, or at least one of the valve 414 and the pump 412 may be disposed in the sub door 200.

Hereinafter, a dispenser as described above will now be described in more detail.

Figure 7:
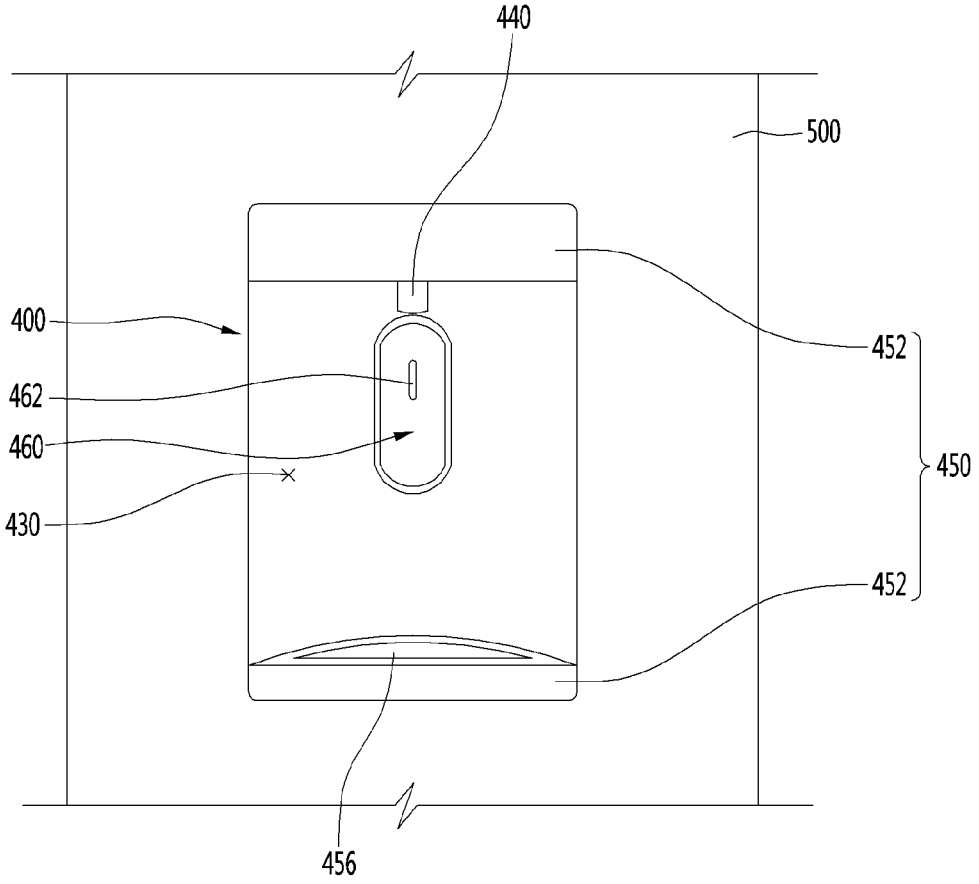
FIG. 7 is a schematic view illustrating a dispenser of the refrigerator of FIG. 1.
Figure 8:
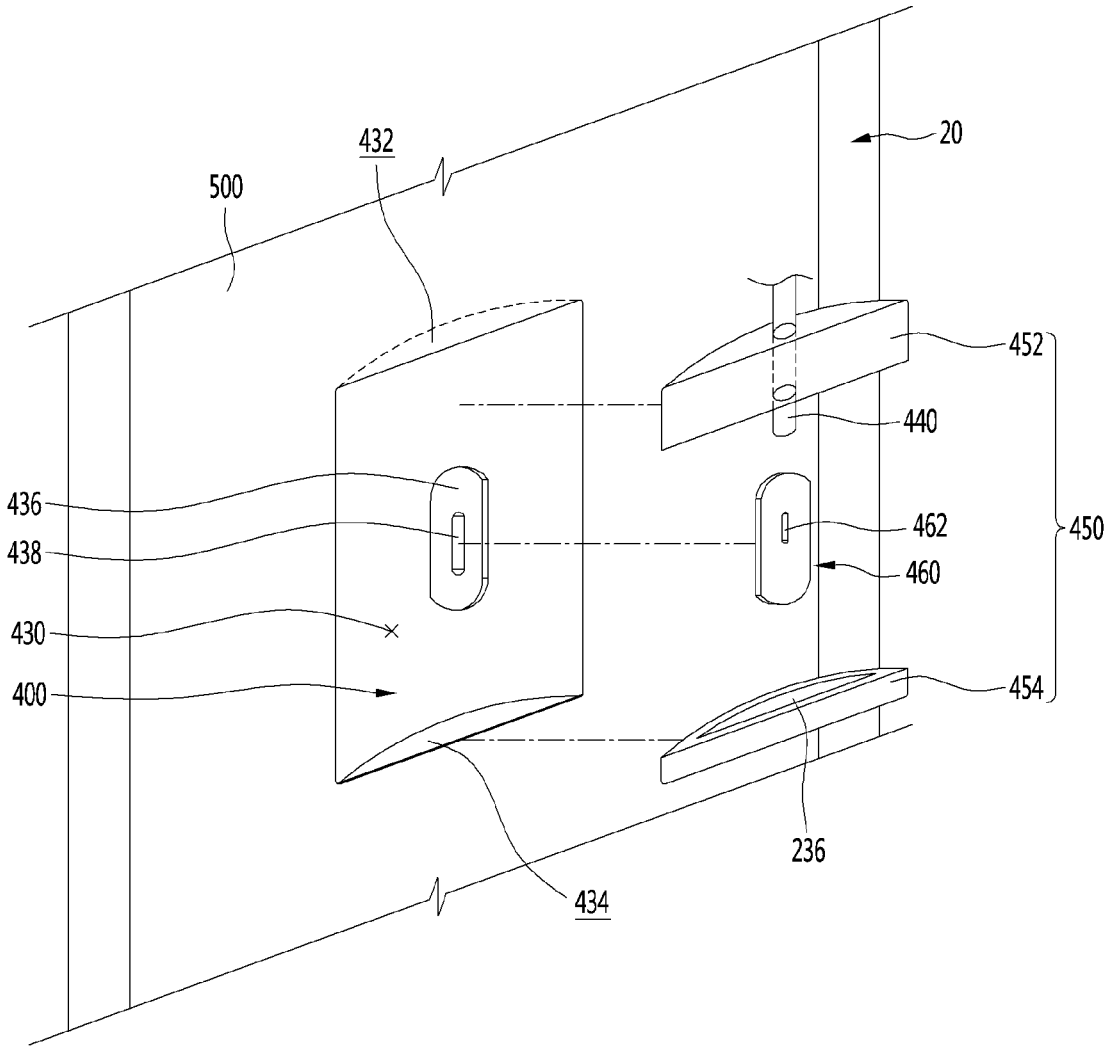
FIG. 8 is an exploded perspective view illustrating the dispenser of FIG. 7.

FIG. 7 is a schematic view illustrating a dispenser according to the current embodiment. FIG. 8 is an exploded perspective view illustrating the dispenser of FIG. 7.

Referring to FIGS. 7 and 8, the dispenser 400 may include a recess 430, a dispensing member 440, decor members 450, and a manipulation member 460.

In detail, the recess 430 provides a space for receiving a container such as a cup during the dispensing of drinking water, and is integrally formed with the outer case 500. The recess 430 may be formed by recessing a portion of the outer case 500 inward. The recess 430 may have a curved surface increasing in depth toward the center thereof.

Portions of the outer case 500, which correspond to the upper and lower ends of the recess 430, are cut, and then, the recess 430 is formed. Cut parts 432 and 434 formed by cutting the portions of the recess 430 may correspond to the width of the recess 430. The recess 430 may have a depth corresponding to the diameter of the dispensing member 440 to be described later.

The cut parts 432 and 434 may be formed before forming the recess 430, and may receive the dispensing member 440. The cut parts 432 and 434 are naturally opened by forming the recess 430, and an open depth thereof is determined according to a depth of the recess 430.

The cut parts 432 and 434 may be disposed at the upper and lower sides of the recess 430, respectively, and are opened toward the center of the recess 430. The cut parts 432 and 434 may have the same shape. Alternatively, the cut part 432 may be larger than the cut part 434. In this case, the recess 430 may be inclined.

The dispensing member 440 may be disposed in the center of the cut part 432 at the position having the largest width. The dispensing member 440 has a pipe or tube shape, and may be exposed to the recess 430 through the cut part 432. The dispensing member 440 may be integrally formed with an upper decor 452 to be described later.

The decor members 450 are disposed on the cut part 432 disposed over the recess 430 and the cut part 434 disposed under the recess 430, respectively. The decor members 450 cover the cut part 432 and the cut part 434, and may be formed of a different material from that of the outer case 500. The decor members 450 may be formed of a plastic material, and be colored or coated with a metal texture after injection molding.

The decor members 450 may include the upper decor 452 and a lower decor 454. The upper decor 452 covers the cut part 432 disposed over the recess 430. The upper decor 452 is installed upward from the outside of the recess 430 to cover the cut part 432. The dispensing member 440 may be installed in the middle of the upper decor 452. A portion of the upper decor 452 constitutes a portion of an appearance over the recess 430.

The lower decor 454 covers the cut part 434 disposed under the recess 430. The lower decor 454 is installed downward from the outside of the recess 430 to cover the cut part 434. The lower decor 454 may include a water collecting part 236 recessed downward. The water collecting part 236 collects the remainder of water dropping to the recess 430. The lower decor 454 may be removed to dump out the water from the water collecting part 236.

The manipulation member 460 is disposed in the center of the recess 430. The manipulation member 460 may be pressed to operate it, like a button or a lever. Alternatively, since the recess 430 is shallow, the manipulation member 460 may sense a touch to determine whether to supply water.

The manipulation member 460 may be installed in an installation part 436 further recessed from the center of the recess 430. The installation part 436 may include an installation hole 438 in which electric/electronic parts such as an LED lighting device 462 and a switch connected to the manipulation member 460 can be installed. A wire may be connected through the installation hole 438 to the LED lighting device 462 provided to the manipulation member 460. The installation part 436 may allow a back-and-forth movement or a rotation of the manipulation member 460.

Hereinafter, a method of manufacturing a door of a refrigerator as configured above will now be described according to the current embodiment.

Figure 9:
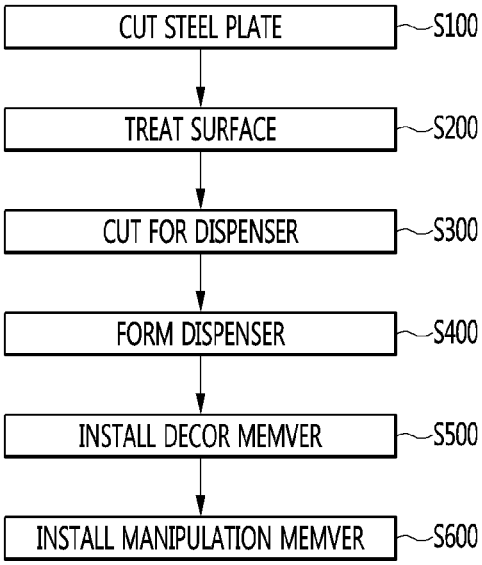
FIG. 9 is a block diagram illustrating a method of manufacturing a refrigerator door of the refrigerator of FIG. 1.

FIG. 9 is a block diagram illustrating a method of manufacturing a refrigerator door according to the current embodiment.

Referring to FIG. 9, first, the outer case 500 is formed to form the door 20. In operation S100, the outer case 500 is formed by cutting a stainless steel plate wound in a roll shape, to correspond to the size of the door 20.

A surface of the cut stainless steel plate is treated with a figure or pattern in operation S200. For example, a hairline process may be performed on the surface of the stainless steel plate to provide a rich texture or anti-fingerprint characteristics. In addition, a figure may be formed using a corrosion such as etching, or various textures can be expressed through a grinding process.

Then, edges of the outer case 500 are bent to form edges of the sub door 200. The outer case 500 may have a curved surface that protrudes in the center thereof, according to a shape of the door 20.

When the forming of the outer case 500 is completed, the outer case 500 is cut to form the cut parts 432 and 434 at positions corresponding to the upper and lower ends of the recess 430 in operation S300. At this point, the installation hole 438 may be formed in the installation part 436. The cut parts 432 and 434 are formed to correspond to the width of the recess 430. At this point, if necessary, other holes may be formed in the outer case 500.

After the forming of the cut parts 432 and 434, a portion of the outer case 500 corresponding to the recess 430 is recessed in operation S400. Thus, the recess 430 has a curved surface protruding rearward. The cut parts 432 and 434 are naturally formed at the upper and lower sides of the recess 430 by forming the recess 430.

While the recess 430 is formed, the installation part 436 may also be formed. Alternatively, after the recess 430 is formed, the installation part 436 may be formed through a separate forming process.

After the forming of the recess 430, the decor members 450 are installed on the cut parts 432 and 434 in operation S500. That is, the upper decor 452 is installed on the cut part 432 disposed over the recess 430. At this point, the dispensing member 440 coupled to the upper decor 452 may be installed in the cut part 432, together with the upper decor 452. Alternatively, after the upper decor 452 is installed on the cut part 432, the dispensing member 440 may be coupled to the upper decor 452.

Then, the lower decor 454 is fixed to the cut part 434 disposed under the recess 430. The lower decor 454 may be detachably fixed to the cut part 434 to remove the remainder of water.

In operation S600, the manipulation member 460 is installed in the installation part 436. The manipulation member 460 can be operated in the installation part 436 according to a method of manipulating the manipulation member 460.

A button switch for driving the manipulation member 460 may be installed in the installation hole 438 of the installation part 436. The lighting device 462 such as an LED provided to the manipulation member 460, or a wire connected to electric/electronic parts pass through the installation hole 438.

After the installing of the manipulation member 460 and the installing of the decor members 450, a water supply passage and a power line, which extend to the recess 430, are fixed. Next, the outer case 500 is coupled to the door liner 510 constituting the inner surface of the door 20. A cap decor constituting an edge of the door 20 may be installed to form an appearance of the door 20.

A space between the outer case 500 and the door liner 510 may be filled with a thermal insulator through a foaming process, thereby completing the forming of the door 20.

Hereinafter, operations of a refrigerator configured as described above will now be described.

The freezer door 22 is opened to take out a food from the freezer compartment 12. The refrigerator door 24 is opened to take out a food from the refrigerator compartment 14.

To take out a food from the refrigerator compartment 14, a user rotates the main door 100 with holding the door handle 26 of the main door 100 and opens the refrigerator compartment 14. When the main door 100 is opened, the front surface of the refrigerator compartment 14 is completely exposed, and a food can be put in the refrigerator compartment 14.

The main door 100 or the sub door 200 is opened to take out a food from the storage space 300 in the main door 100.

When the main door 100 is rotated and completed opened, the refrigerator compartment 14 is opened, and simultaneously, the rear surface of the main door 100 can be exposed. Thus, the rear surface of the storage space 300 can be exposed, and the cover 316 covering the storage space 300 can be opened and closed to take out or put in a food in the storage members 314. After the main door 100 is opened, the water tank 120 may be removed from the main door 100 to provide the water tank 120 with water to supply to the dispenser 400.

The sub door 200 may be rotated to open the storage space 300. To this end, a hand may be put into the sub door handle 228 between the refrigerator door 24 and the freezer door 22, and the sub door 200 may be pulled and rotated.

The sub door 200 rotates about the sub hinge 240 as an axis, and thus, the front portion of the storage space 300 is exposed. When the storage space 300 is opened, a user can take out or put in a food in the storage space 300.

A user can dispense water outside the refrigerator by manipulating the dispenser 400. When the dispenser 400 is manipulated, water is supplied from the water tank 120 through the water supply passage 410 to the dispenser 400 disposed in the sub door 200. After water is completely discharged from the water tank 120, the main door 100 may be opened, then, the water tank 120 may be removed, then, the water tank 120 may be filled with water, and then, the water tank 120 may be installed again on the main door 100 to use the dispenser 400.

A refrigerator according to various other embodiments may be exemplified. Hereinafter, a refrigerator will now be described with reference to the accompanying drawings according to another embodiment.

In the current embodiment, the dispenser is provided to the sub door, and a water tank disposed in the refrigerator compartment is connected to the dispenser through a water supply passage, so that water can be dispensed outside of the refrigerator. Thus, in the current embodiment, the rest parts except for the water tank and the water supply passage are the same as those of the previous embodiment, a description thereof will be omitted, and like reference numeral denote like elements.

Figure 10:
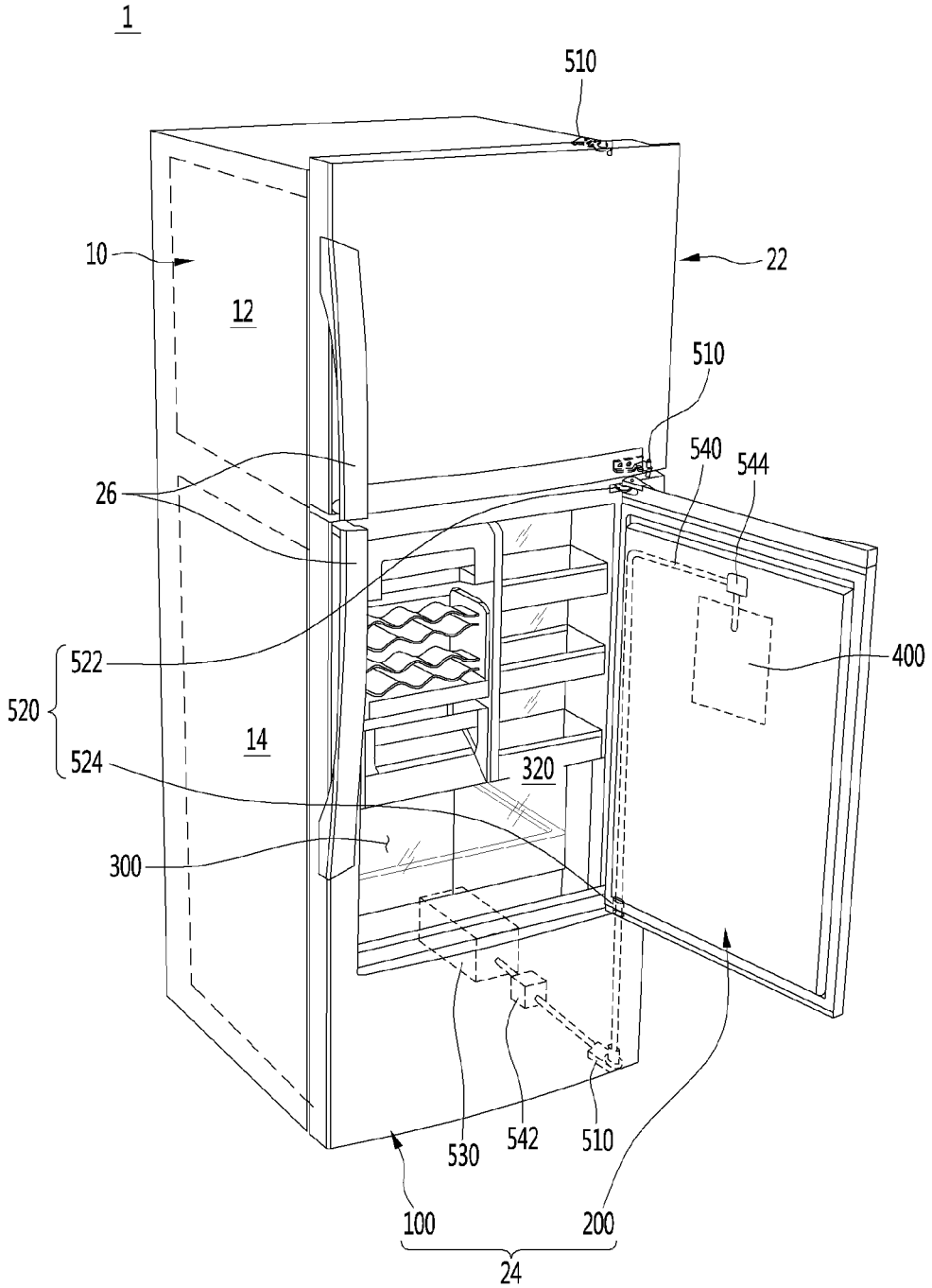
FIG. 10 is a perspective view illustrating a water supply passage of a refrigerator according to another embodiment.

FIG. 10 is a perspective view illustrating a water supply passage of a refrigerator according to the current embodiment.

Referring to FIG. 10, the refrigerator 1 includes the cabinet 10 forming a storage space, the refrigerator door 24 opening and closing the refrigerator compartment 14 in the cabinet 10, and the freezer door 22 opening and closing the freezer compartment 12 in the cabinet 10. The cabinet 10, the refrigerator door 24, and the freezer door 22 form an appearance of the refrigerator 1.

The refrigerator door 24 includes the main door 100 opening and closing the refrigerator compartment 14, and the sub door 200 opening and closing the storage space 300 disposed in the main door 100. The sub door 200 includes the dispenser 400 to dispense water at the outside of the refrigerator 1.

The main door 100 can be rotated through a main hinge 510 supporting the upper and lower ends of the main door 100. The sub door 200 can be rotated through sub hinges 520 including an upper sub hinge 522 and a lower sub hinge 524.

Water to be supplied to the dispenser 400 is stored in a water tank 530 disposed in the refrigerator compartment 14. The water tank 530 disposed in the refrigerator compartment 14 can be removed from the refrigerator compartment 14 to fill the water tank 530 with water.

The dispenser 400 is connected to the water tank 530 through a water supply passage 540. A pump 542 and a valve 544 may be installed on the water supply passage 540, and thus, the dispenser 400 operates to supply water from the water tank 530 to the dispenser 400.

The water supply passage 540 for supplying water from the water tank 530 in the refrigerator compartment 14 to the dispenser 400 of the sub door 200 sequentially passes through the main hinge 510 and the sub hinge 520.

The water supply passage 540 is connected to the water tank 530 in the refrigerator compartment 14. Thus, the water supply passage 540 is guided into the main door 100 through the main hinge 510 disposed under the main door 100, and is guided into the sub door 200 through the lower sub hinge 524, and thus, can be connected to the dispenser 400. The water supply passage 540 is disposed in the cabinet 10, the main door 100, and the sub door 200, and may be embedded in a thermal insulator.

Also when the dispenser 400 includes a lighting device or electric/electronic parts, a wire to be connected to the dispenser 400 can be guided to the dispenser 400 or the sub door 200 through the main hinge 510 and the sub hinges 520.

A refrigerator according to various other embodiments than the previous embodiments may be exemplified. Hereinafter, a refrigerator will now be described with reference to the accompanying drawings according to another embodiment.

In the current embodiment, the dispenser is provided to the sub door, and a water supply pipe connected to the dispenser is connected to a water supply source disposed outside the refrigerator, so that water can be dispensed through the dispenser. Thus, in the current embodiment, the rest parts except for the water supply passage are the same as those of the previous embodiments, a description thereof will be omitted, and like reference numeral denote like elements.

Figure 11:
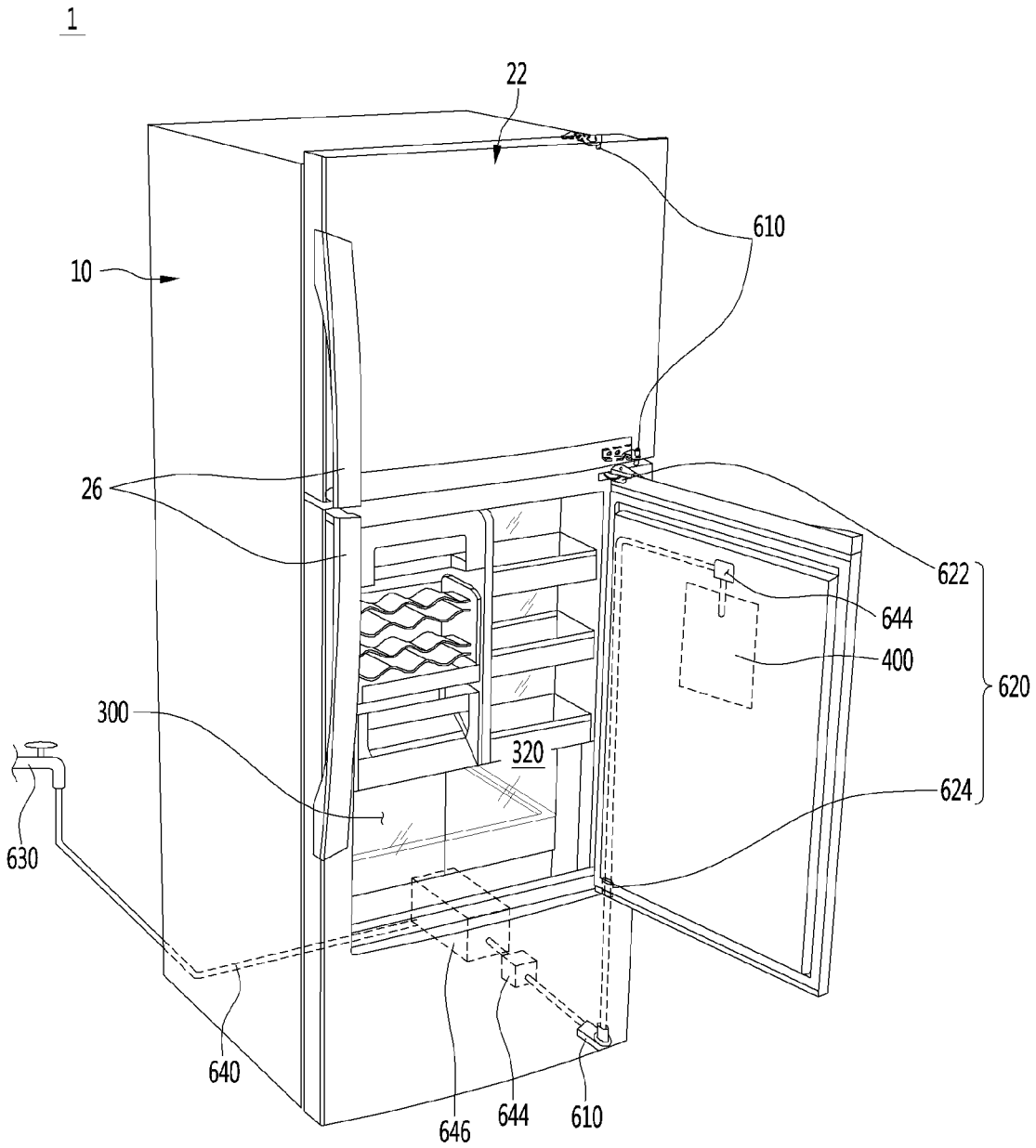
FIG. 11 is a perspective view illustrating a water supply passage of a refrigerator according to another embodiment.

FIG. 11 is a perspective view illustrating a water supply passage of a refrigerator according to the current embodiment.

Referring to FIG. 11, the refrigerator 1 includes the cabinet 10 forming a storage space, the refrigerator door 24 opening and closing the refrigerator compartment 14 in the cabinet 10, and the freezer door 22 opening and closing the freezer compartment 12 in the cabinet 10. The cabinet 10, the refrigerator door 24, and the freezer door 22 form an appearance of the refrigerator 1.

The refrigerator door 24 includes the main door 100 opening and closing the refrigerator compartment 14, and the sub door 200 opening and closing the storage space 300 disposed in the main door 100. The sub door 200 includes the dispenser 400 to dispense water at the outside of the refrigerator 1.

The main door 100 can be rotated through a main hinge 610 supporting the upper and lower ends of the main door 100. The sub door 200 can be rotated through sub hinges 620 including an upper sub hinge 622 and a lower sub hinge 624.

Water dispensed by the dispenser 400 is supplied from a water supply source 630 disposed outside the refrigerator 1. The water supply source 630 is connected to a water pipe or a water supply passage 640 at the outside of the refrigerator 1 to supply water from the outside of the refrigerator 1.

The water supply passage 640 connects the water supply source 630 to the dispenser 400. Thus, a portion of the water supply passage 640 is exposed out of the refrigerator 1, and is connected to the water supply source 630. A portion of the water supply passage 640 in the refrigerator 1 passes through the cabinet 10. The water supply passage 640 is guided into the main door 100 through the main hinge 610 disposed under the main door 100, and is guided into the sub door 200 through the lower sub hinge 624, and thus, can be connected to the dispenser 400.

At least one pump 642 and at least one valve 644 are disposed on the water supply passage 640, and thus, the dispenser 400 operates to supply water from a water tank 646 to the dispenser 400. The water supply passage 640, the pump 642, and the valve 644 are disposed in the cabinet 10, the main door 100, and the sub door 200, and may be embedded in a thermal insulator.

Also when the dispenser 400 includes a lighting device or electric/electronic parts, a wire to be connected to the dispenser 400 can be guided to the dispenser 400 or the sub door 200 through the main hinge 610 and the sub hinges 620.

Although the main door and the sub door constitute the refrigerator door in the previous embodiments, the main door and the sub door may constitute a freezer door in another embodiment. Furthermore, the main door and the sub door may constitute a refrigerator door including only a single rotatable door, and thus, may be applied to any refrigerator including a dispenser.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

According to the embodiments, since the dispenser is installed on the sub door, the dispenser can be conveniently used. In addition, since the dispenser is integrally from with the outer case forming an appearance of the door, the appearance of the refrigerator is improved, and a manufacturing process is simplified, thereby improving the productivity.

The invention claimed is:

1. A refrigerator door, comprising:

an outer case that comprises a metal plate, that defines an exterior of the refrigerator door, and that defines a recess and a first cut part;

an upper decor that is located at the first cut part of the outer case and that covers the first cut part; and a dispensing member that extends through the upper decor from the outer case and that includes a pipe or tube shape to dispense water, wherein the upper decor covers an upper portion of the recess of the outer case, wherein the recess is defined by a concave portion of the metal plate and is recessed towards a rear of the door, and wherein the first cut part defines a first void in the metal plate, defines a first cut part plane that is perpendicular to the metal plate, and is located at an upper end of the recess.

2. The refrigerator door according to claim 1, wherein a figure or a pattern is formed on an entire outer surface of the outer case including the recess.

3. The refrigerator door according to claim 1, wherein the recess is defined by a curved surface increasing in depth towards a center thereof.

4. The refrigerator door according to claim 1, wherein:

the metal plate defines a second cut part that defines a second cut part plane that is perpendicular to the metal plate and that is parallel to the first cut part plane, that defines a second void in the metal plate, and that is located at a lower end of the recess, and the refrigerator door comprises a lower decor that is located in and that covers the second cut part.

5. The refrigerator door according to claim 4, wherein:

the first cut part is larger than the second cut part, a recess plane that is tangential to the concave portion of the metal plate and the metal plate define an acute angle.

6. The refrigerator door according to claim 4, further comprising a water collecting part that is recessed downward in the lower decor and that is configured to collect water dropping to the lower decor.

7. The refrigerator door according to claim 4, wherein the lower decor is detachable.

8. The refrigerator door according to claim 3, wherein a portion of a perimeter of the first cut part is defined by an arc with a diameter of the dispensing member.

9. The refrigerator door according to claim 1, further comprising a manipulation member that is located in the recess and that is configured to dispense water in response to being manipulated.

10. The refrigerator door according to claim 9, wherein the concave portion of the metal plate defines an installation part that is located in a center of the recess and that is configured to receive the manipulation member.

* * * * *